US008721014B2

(12) United States Patent
Yang

(10) Patent No.: US 8,721,014 B2
(45) Date of Patent: May 13, 2014

(54) REFRIGERATOR

(71) Applicant: Changwoan Yang, Changwon-si (KR)

(72) Inventor: Changwoan Yang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/660,438

(22) Filed: Oct. 25, 2012

(65) Prior Publication Data

US 2013/0106274 A1 May 2, 2013

(30) Foreign Application Priority Data

Oct. 26, 2011 (KR) ..... 10-2011-0109635

(51) Int. Cl.
*A47B 96/04* (2006.01)

(52) U.S. Cl.
USPC ..... 312/408; 108/107

(58) Field of Classification Search
USPC ..... 312/408, 410; 108/106–110
See application file for complete search history.

(56) References Cited

U.S. PATENT DOCUMENTS

| | | | | |
|---|---|---|---|---|
| 3,456,996 | A * | 7/1969 | Heiniger-Schar | 312/334.22 |
| 5,642,924 | A * | 7/1997 | Wohlrab et al. | 312/408 |
| 5,893,620 | A * | 4/1999 | Birgelis | 312/408 |
| 8,511,769 | B2 * | 8/2013 | Busalt et al. | 312/410 |
| 2005/0258725 | A1 * | 11/2005 | Jang | 312/408 |
| 2006/0163985 | A1 * | 7/2006 | Blersch et al. | 312/408 |
| 2007/0063627 | A1 * | 3/2007 | Bienick et al. | 312/408 |
| 2007/0228909 | A1 * | 10/2007 | Hwang et al. | 312/408 |
| 2008/0203041 | A1 * | 8/2008 | Lim et al. | 211/119.003 |
| 2009/0015123 | A1 * | 1/2009 | Lee et al. | 312/404 |
| 2009/0056365 | A1 * | 3/2009 | Benz et al. | 62/441 |
| 2009/0084914 | A1 * | 4/2009 | Picken et al. | 248/206.5 |
| 2009/0188877 | A1 * | 7/2009 | Stewart | 211/71.01 |
| 2010/0026156 | A1 * | 2/2010 | Leconte et al. | 312/408 |
| 2012/0036879 | A1 * | 2/2012 | Candeo et al. | 62/187 |

FOREIGN PATENT DOCUMENTS

WO WO 2010099464 A2 * 9/2010 ..... F25D 17/04

* cited by examiner

*Primary Examiner* — Hanh V Tran
(74) *Attorney, Agent, or Firm* — McKenna Long & Aldridge LLP

(57) ABSTRACT

A refrigerator includes a shelf having one end supported by a protruded end and an other end fixed to a shelf mounting member to more stably mount the shelf. Also, a structure for mounting the shelf is simplified.

7 Claims, 8 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2011-0109635 (Oct. 26, 2011), which is hereby incorporated by reference in its entirety.

BACKGROUND

The present disclosure relates to a refrigerator.

In general, refrigerators are home appliances for storing foods at a low temperature in a storage space covered by a refrigerator door. That is, refrigerators cool the inside of the storage space using cool air generated by heat-exchanging with a refrigerant circulating according to a refrigeration cycle to store foods in an optimum state.

With the change in dietary life and the trends of higher grade of living, large and multifunctional refrigerators have been introduced, and have been developed in various structures for user's convenience.

For example, a refrigerating compartment is increased in capacity and is defined above a freezing compartment to improve user's convenience. There is a bottom freezer type refrigerator in which a refrigerating compartment is opened or closed by a pair of doors. Hereinafter, the bottom freezer type refrigerator will be described with reference to the accompanying drawing.

FIG. 1 is a front view illustrating the inside of a refrigerating compartment of a refrigerator according to a related art.

Referring to FIG. 1, the inside of a refrigerator is partitioned by a barrier 11 to define a refrigerating compartment 1 and a freezing compartment (not shown). Also, a plurality of shelves 20 for storing various foods are provided inside the refrigerating compartment 1. A cool air duct 30 for uniformly supplying cool air is disposed in a center of the inside of the refrigerating compartment 1. A plurality of cooling air discharge holes 31 are defined in the cool air duct 30. Thus, the inside of the refrigerator may be uniformly cooled by the plurality of cool air discharge holes 31.

Here, each of the shelves 20 may be a cantilever type shelf. In the cantilever type shelf, a rear end thereof is fixed and supported inside the refrigerator, and the shelf is detachably disposed. Thus, the cantilever type shelf may be mounted on various heights. Also, the shelves 20 may be disposed on both left and right sides of an inner space of the refrigerator, respectively. In addition, the left and right shelves 20 may be disposed at different heights to create various inner spaces in the refrigerating compartment 1 according to the arrangement of the shelves 20.

To mount the shelves 20, a first shelf mounting member 41 is disposed on a central portion of the cool air duct 30, and second shelf mounting members 42 are disposed on both left and right ends of a rear wall of the refrigerating compartment 1. Each of the first shelf mounting member 41 and the second shelf mounting members 42 may be formed of a steel material. Also, the first shelf mounting member 41 and the second shelf mounting members 42 are vertically disposed. Also, a plurality of mounting grooves 43 are vertically defined with a predetermined distance in the mounting members 41 and 42 so that the shelves 20 are mounted at desired heights.

Thus, the shelf 20 has one side fixed to one of the second shelves mounting members 42 disposed on the rear wall of the refrigerating compartment 1 and the other side fixed to the first shelf mounting member 41 disposed on the central portion of the cool air duct 30. A user may attach or detach the shelves 20 to mount the shelves 20 at desired heights.

However, the refrigerator having the above-described structure has the following limitations.

When the shelf 20 is fixed to both left and right sides of the refrigerating compartment 1, a rear end of the shelf 20 may be fixed. Here, since the rear end of the cantilever type shelf 20 is fixed to the first shelf mounting member 41 and the second shelf mounting members 42, the shelf 20 may be damaged in a case where heavy food is disposed on a front portion of the shelf 20.

Also, to fix the shelf 20, the first shelf mounting member 41 and the second shelf mounting members 42 should be provided. Here, the second shelf mounting members 42 should be mounted in an inner case defined in the refrigerating compartment 1. To mount the second shelf mounting members 42 in the inner case 50, a separate fixing structure or fixing member should be provided. Also, a structure for preventing an insulation material from leaking should be additionally provided. Thus, the whole structure of the refrigerator 1 may be relatively complicated.

Also, in the state where the rear end of the shelf 20 is fixed, it may be difficult to stably withdraw the shelf 20, or a separate component for withdrawing the shelf 20 should be additionally provided.

SUMMARY

Embodiments provide a refrigerator in which a shelf has one end supported by a protruded end and the other end fixed to a shelf mounting member to more stably mount the shelf, and a structure for mounting the shelf is simplified.

In one embodiment, a refrigerator includes: a cabinet defining a storage space opened or closed by a door; a shelf disposed in the storage space to seat foods thereon; a cool air duct disposed in the storage space to supply cool air into the storage space; a shelf mounting member disposed in the storage space, the shelf mounting member having a plurality of mounting grooves, in which the shelf is mounted, at a predetermined distance; and an end protruding from at least one of left and right walls of the storage space, the protruded end laterally support the shelf, wherein the shelf includes: a seat part disposed on one end of the shelf corresponding to the protruded end, the seat part being seated on the protruded end to support the shelf; and a support bracket disposed on an other end facing the seat part, the support bracket being inserted into the mounting grooves to support the shelf.

The protruded end is a molded end and an inner case defining the inside of the storage space may protrude to form the molded end.

The protruded end may be disposed at a height corresponding to that of the mounting groove.

The cool air duct may be vertically disposed on a center of the inside of the storage space, a mounting member receiving part in which the shelf mounting member is inserted may be defined in a central portion of the cool air duct, and a cool air passage and a discharge hole may be defined in both left and right sides of the cool air duct with respect to the mounting member receiving part.

The seat part may be recessed in a shape corresponding to that of the protruded end to surround the protruded end.

The support bracket may be slidably movably mounted on the shelf.

The shelf may include: a shelf plate having a surface on which foods are disposed; and a shelf frame disposed along a circumference of the shelf plate to define an edge of the shelf frame, wherein the shelf frame may be recessed to form the seat part.

The support bracket may be mounted on an end of the shelf frame facing the seat part.

The shelf may include a bracket mounting part extending in a length direction along a side end of the shelf where the support bracket is disposed, the bracket mounting part assembled with the support bracket so that the shelf is slidably movable with respect to the support bracket and supported by the seat part and the support bracket.

The support bracket may be slidably mounted on the shelf, and when the shelf is withdrawn, the seat part may be moved along the protruded end, and the support bracket may be maintained in a state in which the support bracket is fixed to the shelf mounting member.

The mounting groove includes a plurality of mounting grooves that may be vertically defined in two rows, and a pair of shelves may be disposed on both left and right sides with respect to the plurality of mounting grooves.

The protruded end includes a plurality of protruded ends that may be disposed on each of both left and right surfaces of the storage space.

The support bracket includes a bent part, and the bent part is inserted into the bracket mounting part so that the shelf is movable in front and rear directions along the support bracket.

The bracket mounting part includes a rib disposed in a space defined by the bent part to prevent the support bracket from being separated from the bracket mounting part.

The molded end may be mounted within the storage space in a state where the molded end is molded using a separate material.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described in detail with reference to the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

Figure 1:
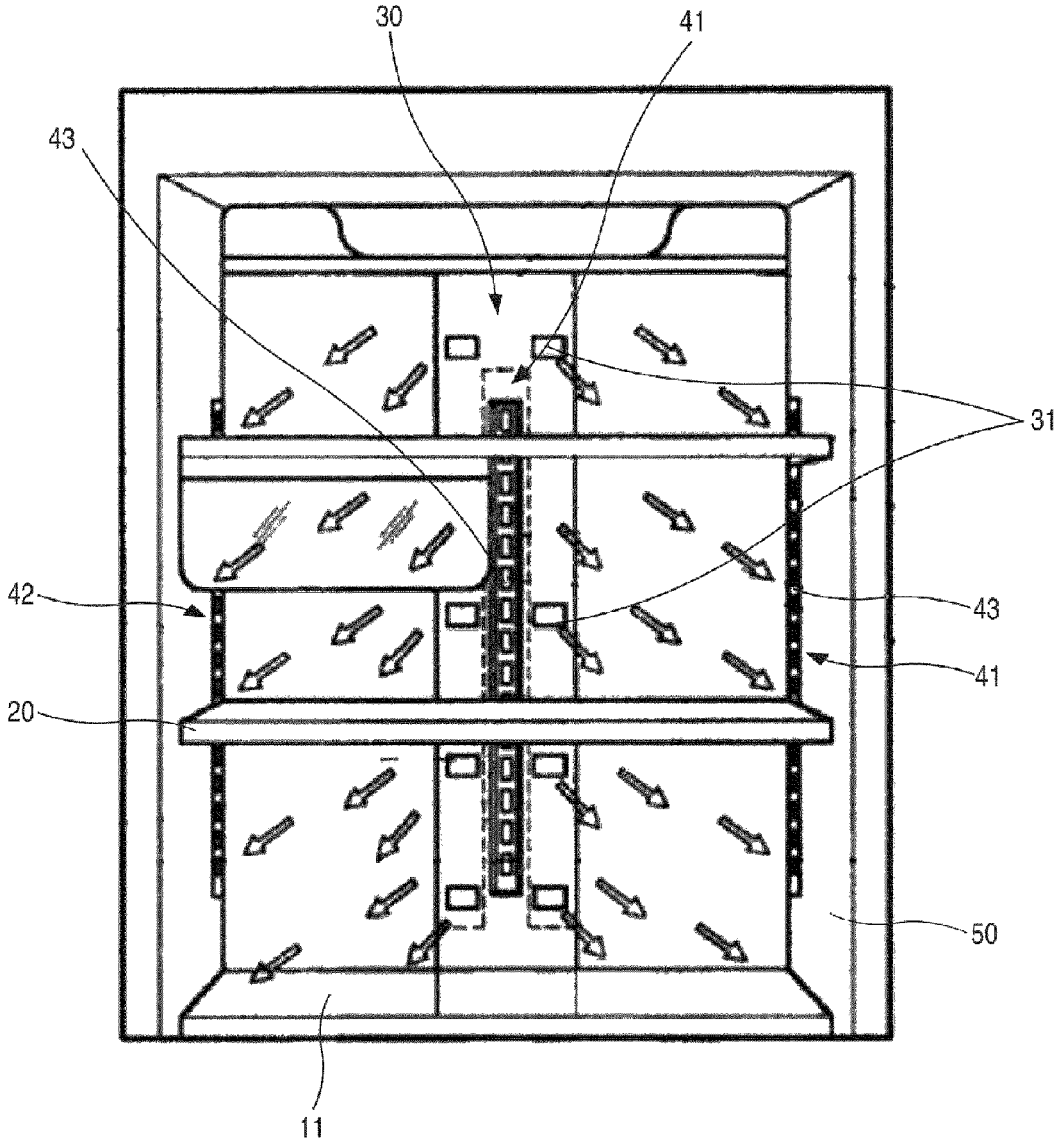
FIG. 1 is a front view illustrating an inside of a refrigerating compartment of a refrigerator according to a related art.
Figure 2:
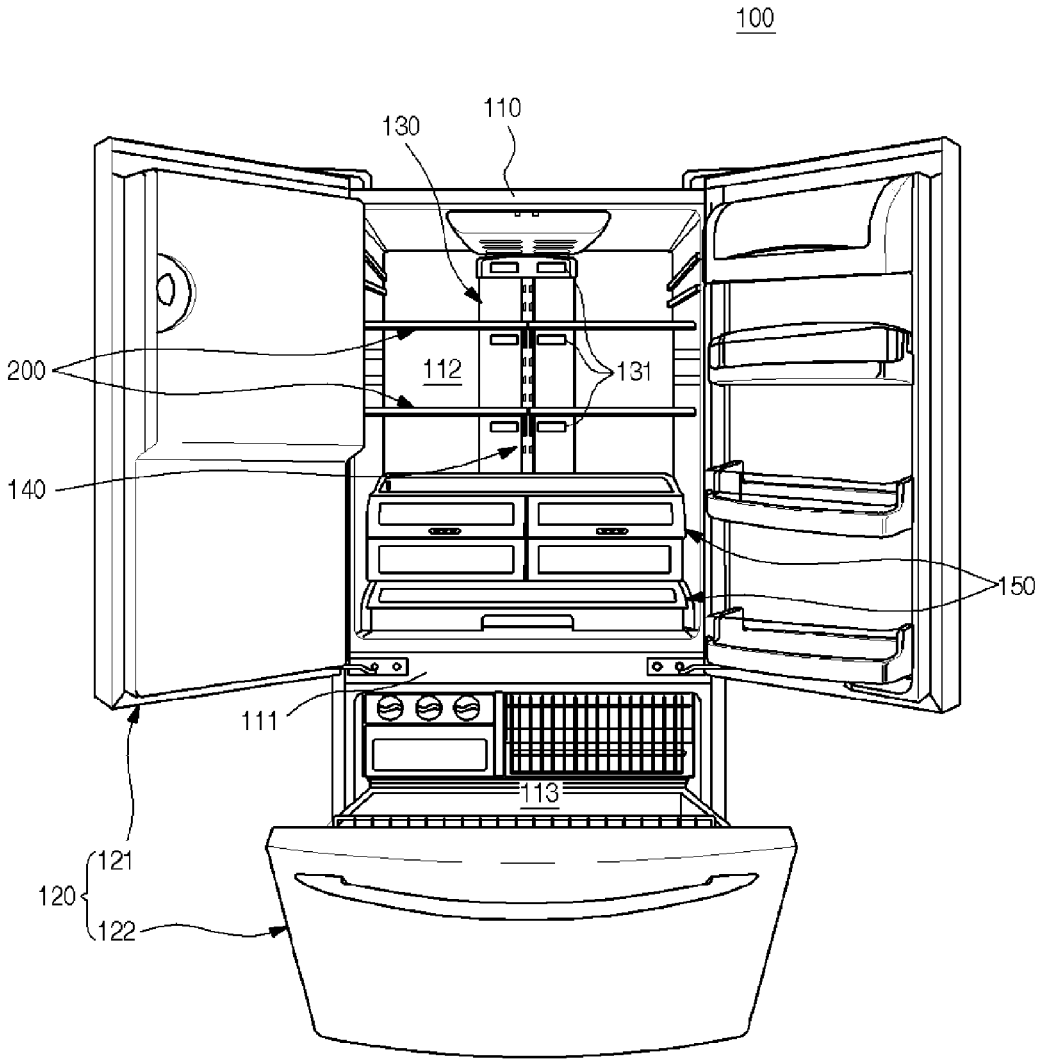
FIG. 2 is a front view of a refrigerator with a door opened according to an embodiment.
Figure 3:
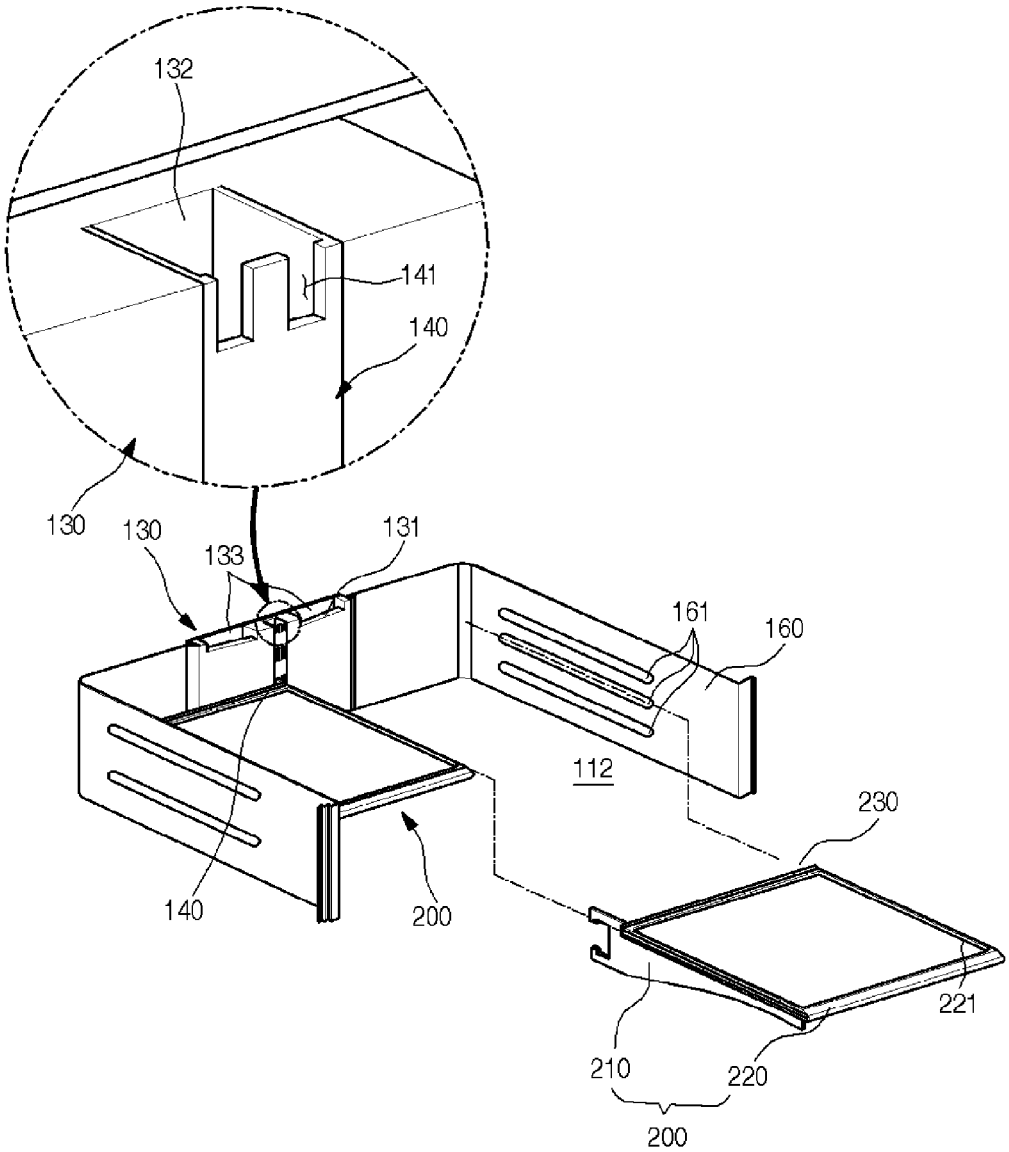
FIG. 3 is a partial perspective view of a refrigerating compartment according to an embodiment.

FIG. 2 is a front view of a refrigerator with a door opened according to an embodiment. FIG. 3 is a partial perspective view of a refrigerating compartment according to an embodiment.

Referring to FIGS. 2 and 3, a refrigerator 100 includes a cabinet 110 defining a storage space therein and a door 120 for selectively covering an opened front surface of the cabinet 110. Here, an outer appearance of the refrigerator 100 may be defined by the cabinet 110 and the door 120.

The inside of the cabinet 110 is partitioned into upper and lower sides by a barrier 111 to define a refrigerating compartment 112 and a freezing compartment 113. The door 120 includes a refrigerating compartment door 121 for covering the refrigerating compartment 112 and a freezing compartment door 122 for covering the freezing compartment 113. The refrigerating compartment door 121 may be provided in a pair. The pair of refrigerating compartment doors 121 may be rotated in both left and right directions to open or close the refrigerating compartment 112. Also, the freezing compartment door 122 may be provided as a drawer structure, and thus withdrawn in front and rear directions to open or close the freezing compartment 113.

A cool air duct 130 in which cool air supplied from the freezing compartment 113 flows is disposed at a center of the inside of the refrigerating compartment 112. The cool air duct 130 is disposed at the center of the refrigerating compartment 112 and mounted on a rear wall of the refrigerating compartment 112. Also, a plurality of cool air discharge holes 131 may be defined in the cool air duct 130 to discharge cool air into the refrigerating compartment 112.

A plurality of shelves 200 for receiving foods may be provided inside the refrigerating compartment 112. Particularly, the shelves 200 provided inside the refrigerating compartment 112 may be divided into left and right sides within the refrigerating compartment 112. Thus, the shelves 200 may be detachably mounted on left and right sidewalls and a rear wall within the refrigerator 100 and independently adjustable in height.

A plurality of drawers 150 are disposed on a bottom surface of the refrigerating compartment 112. Also, the plurality of drawers 150 may be vertically stacked on each other. Also, at least one pair of the plurality of drawers 150 may be respectively disposed on left and right sides and slidably withdrawn.

A shelf mounting member 140 may be disposed on the rear wall of the refrigerating compartment 112 so that the shelves 200 are mounted adjustable in height. Mounting grooves 141 for mounting the shelves 200 are vertically defined with a predetermined distance in the shelf mounting member 140. That is, the shelf mounting member 140 may be disposed on the cool air duct 130 disposed at the center of the refrigerating compartment 112. Here, two shelf mounting members 140 may be provided on the cool air duct 130. The shelf mounting members 140 may be configured so that a pair of mounting grooves 141 is vertically continuously defined, or all of the left and right shelves 200 are inserted and fixed into one mounting groove 141.

A front center of the cool air duct 130 may be recessed inward to define a mounting member receiving part 132 in which the shelf mounting member 140 is inserted. The shelf mounting member 140 may be flush with a front surface of the cool air duct 130 in a state where the shelf mounting member 140 is inserted into the mounting member receiving part 132. The shelf mounting member 140 may be formed of a steel material. The shelf mounting member 140 may be mounted on the cool air duct 130. Also, as necessary, the shelf mounting member 140 may be integrated with the cool air duct 130 when the cool air duct 130 is molded.

Also, the cool air duct 130 has cool air passages 133 in both left and right sides with respect to the shelf mounting member 140 to allow cool air to flow vertically. In addition, the cool air may be supplied into a space between the plurality of shelves 200 through the cool air discharge holes 131 defined between the shelves 200.

A molded end 161 is disposed on an inner case 160 disposed on an inner surface of the refrigerating compartment 112. The molded end 161 is configured to mount the shelf 200. The molded end 161 is disposed on each of left and right side surfaces of the refrigerating compartment 112. That is, when the inner case 160 is molded, a portion of the inner case 160 corresponding to each of the left and right side surfaces of the refrigerating compartment 112 protrudes to mold the molded end 161. The molded end 161 may be provided in plurality at a predetermined vertical distance. Also, the molded end 161 may be disposed lengthwise in front and rear directions to stably support the shelf 200. Here, the molded end 161 may have a shape corresponding to a seat part 221 of the shelf 200 that will be described below. The molded ends 161 may have the same vertical distance as that of the mounting grooves 141 of the shelf mounting member 140. Also, the molded end 161 may have the same height as that of the mounting groove 141.

Thus, a user may mount the shelves 200 disposed on both left and right sides on the shelf mounting member 140 and the molded end 161 which are disposed at desired heights to respectively fix the shelves 200 at the desired heights. Here, the shelves 200 may be disposed at different heights on both left and right sides. Also, as necessary, a portion of the shelves 200 may be removed to create various inner spaces.

Hereinafter, a configuration of the shelf will be described in detail with reference to the accompanying drawings.

Figure 4:
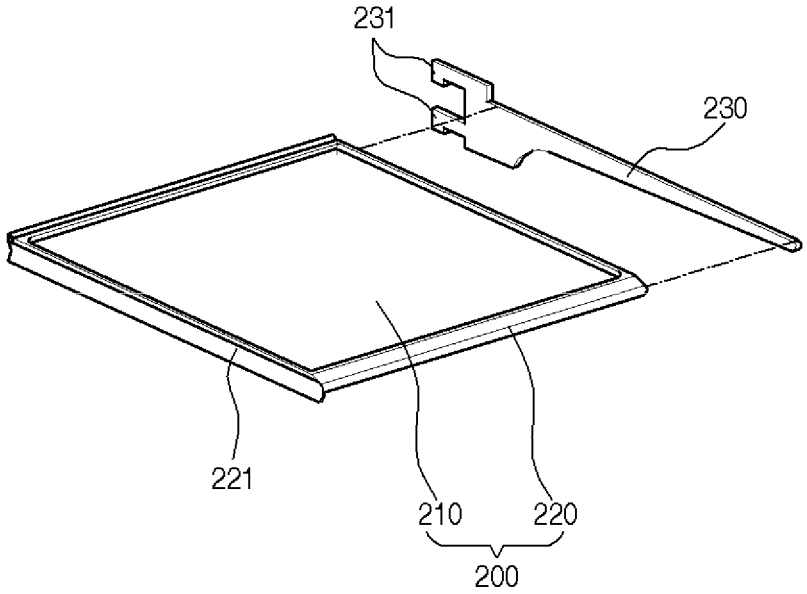
FIG. 4 is an exploded perspective view of a shelf according to an embodiment.
Figure 5:
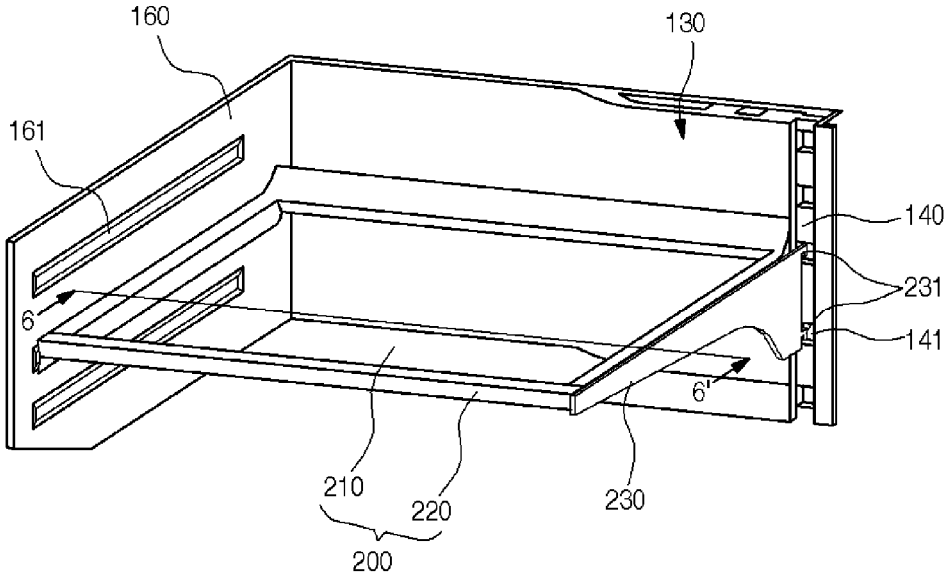
FIG. 5 is a perspective view illustrating a state in which the shelf is mounted.
Figure 6:
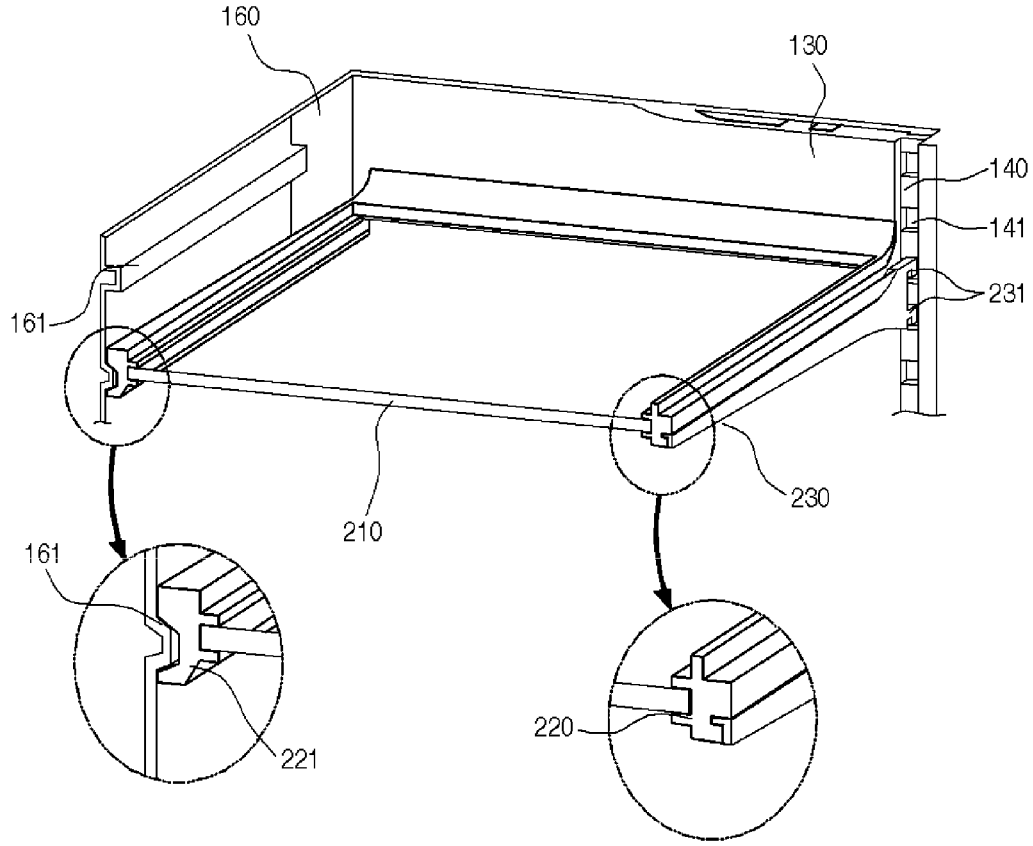
FIG. 6 is a cross-sectional view taken along line 6-6' of FIG. 5.

FIG. 4 is an exploded perspective view of a shelf according to an embodiment. FIG. 5 is a perspective view illustrating a state in which the shelf is mounted. FIG. 6 is a cross-sectional view taken along line 6-6' of FIG. 5.

Referring to FIGS. 4 to 6, the shelf 200 may include a shelf plate 210 having a surface on which foods are seated and a shelf frame 220 disposed along a circumference of the shelf plate 210.

In detail, the shelf plate 210 is formed of a tempered glass or transparent plastic material so that the user sees through the shelf 200 to confirm foods received thereunder.

The shelf frame 220 is disposed around the shelf plate 210. The shelf frame 220 defines an edge of the shelf plate 210. The shelf frame 220 may be manufactured by assembling a separate injection molded part, or the shelf plate 210 may be insert-injected to manufacture the shelf frame 210.

The seat part 221 is disposed on at least a portion of left and right ends of the shelf frame 220 contacting the side wall of the refrigerating compartment 112. The seat part 221 may be recessed inward and have a shape corresponding to that of the molded end 161. Thus, when the shelf 200 is mounted, the seat part 221 is assembled with the molded end 161 to support the shelf 200.

Also, a support bracket 230 may be further disposed on the other end facing the seat part 221. The support bracket 230 is configured to mount the shelf 200. The support bracket 230 may be integrated with the shelf frame 220. That is, when the shelf frame 220 is molded, the support bracket 230 extending downward and backward may be molded together.

Also, as necessary, the support bracket 230 may be separately manufactured with respect to the shelf frame 220. Here, the shelf frame 220 may be provided as a structure in which the support bracket 230 is coupled to the shelf frame 220.

The support bracket 230 extends downward from an end of the shelf frame 220. Also, the support bracket 230 may have a width gradually increasing from a front side toward a rear side. Also, a fixing end 231 extending backward is further disposed on a rear end of the support bracket 230. The fixing end 231 may be disposed on each of upper and lower portions of the rear end of the support bracket 230. The fixing end 231 extends backward and then is bent downward to have a hook shape. Thus, when the shelf 200 is mounted, the fixing end 231 may be inserted into the mounting groove 141. Thus, the fixing end 231 may hook into the mounting groove 141 and be restricted with respect to each other.

In the state where the shelf 200 is mounted as described above, the molded end 161 and the seat part 221 may be assembled with each other, and the support bracket 230 may be fixed to the shelf mounting member 140 to stably maintain the shelf 200.

Hereinafter, an operation of the refrigerator including the above-described components according to an embodiment will be described.

Figure 7:
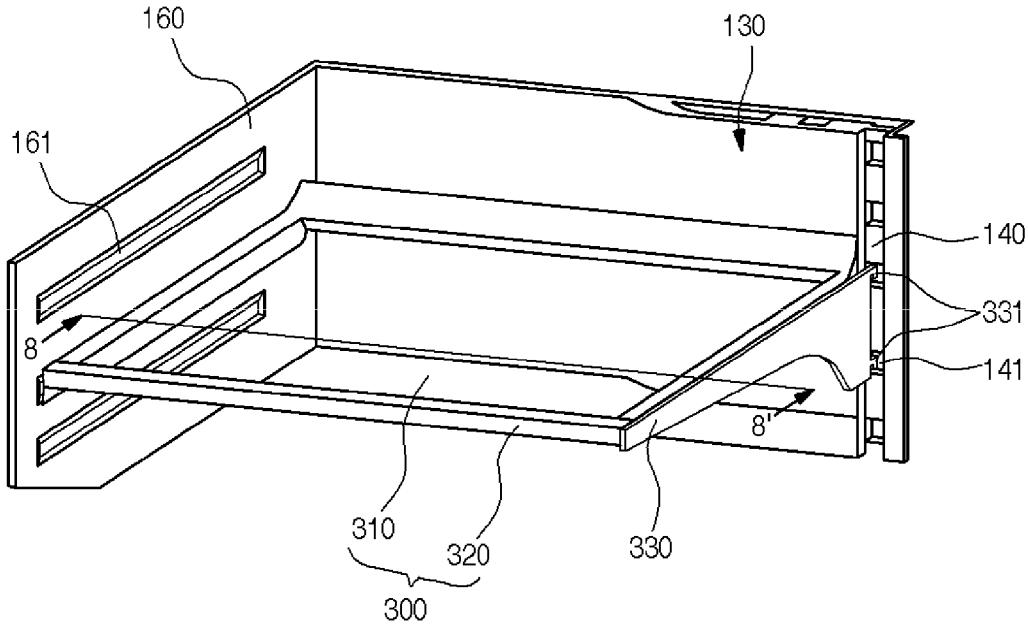
FIG. 7 is a perspective view illustrating a state in which a shelf is mounted according to another embodiment.

The shelf 200 may be disposed on each of the left and right sides of the refrigerating compartment 112. Hereinafter, the shelf 200 mounted on the left side of the refrigerating compartment 112 will be described as an example. As shown in FIG. 7, in a state where the shelf 200 is mounted, the molded end 161 and the seat part 221 are assembled with each other to support a left side of the shelf 200. Also, the fixing end 231 of the support bracket 230 is inserted into the mounting groove 141 of the shelf mounting member 140 to support a right side of the shelf 200.

Here, the molded end 161 and the mounting groove 141 on which the shelf 200 is mounted may have the same height. Thus, the shelf 200 may be supported by the molded end 161 as well as the support bracket 230. As a result, the shelf 200 may be maintained in a stable supported state on the whole region.

In this state, to separate the shelf 200, the user separates the fixing end 231 of the support bracket 230 from the mounting groove 141. Then, the seat part 221 is separated from the molded end 161 to separate the shelf 200 from the refrigerator. Thereafter, the user may mount the shelf 200 again at a desired position. Thus, the user may mount the shelf 200 in various positions. In addition, the inner space of the refrigerating compartment 112 may be variously created through the arrangements of the plurality of shelves 200.

The present disclosure is not limited to the forgoing embodiment and embodies various embodiments.

Hereinafter, another embodiment will be described with reference to the accompanying drawings.

In another embodiment, a support bracket is slidably mounted on an end of a shelf, and also, the shelf is withdrawably supported by a molded end and the support bracket in a state where the shelf is mounted.

Thus, in another embodiment, other components except for a structure of the shelf are equal to those of the foregoing embodiment. Thus, the same component will be indicated by the same reference numeral, and their detailed description will be omitted.

Figure 8:
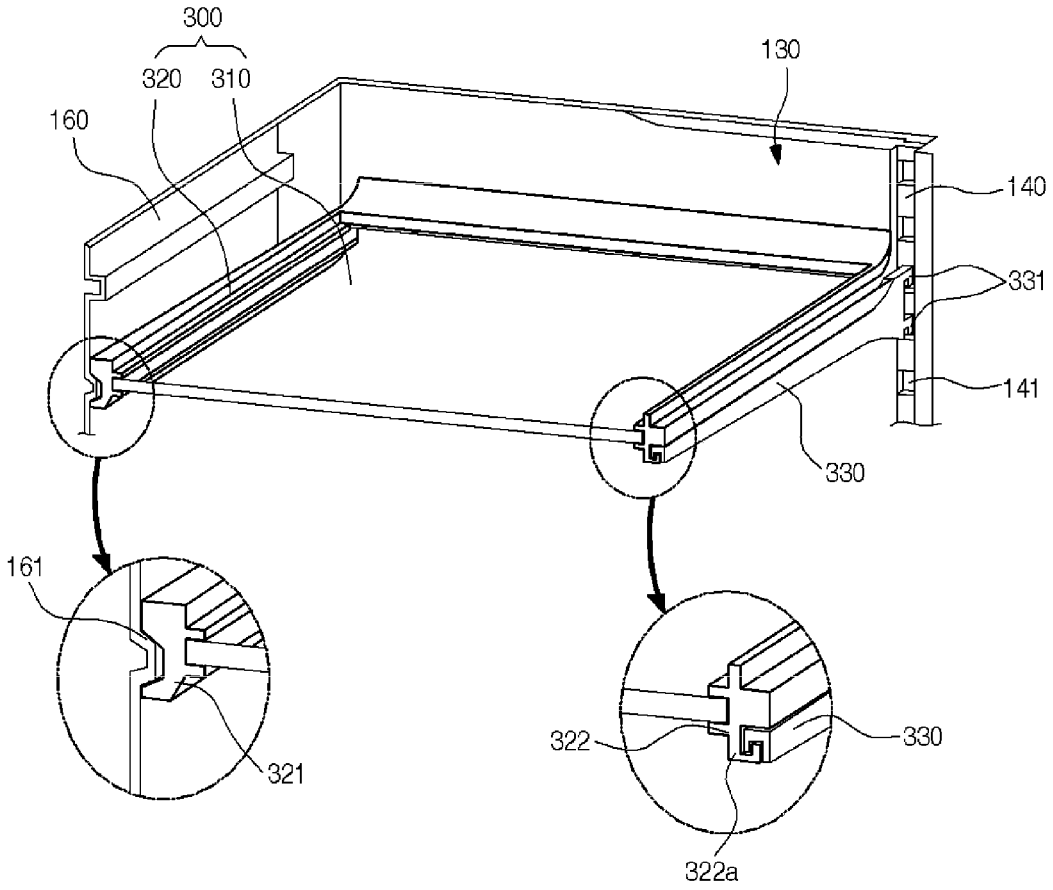
FIG. 8 is a cross-sectional view taken along line 8-8' of FIG. 7.

FIG. 7 is a perspective view illustrating a state in which a shelf is mounted according to another embodiment. FIG. 8 is a cross-sectional view taken along line 8-8' of FIG. 7.

Referring to FIGS. 7 and 8, a shelf 300 according to another embodiment includes a shelf plate 310 having a surface on which foods are seated and a shelf frame 320 disposed along a circumference of the shelf plate 310.

A seat part 321 assembled with a molded end 161 is received in one end of left or right side of the shelf frame 320, and a bracket mounting part 322 on which a support bracket 330 is mounted is disposed on the other end of the shelf frame 320.

In detail, the seat part 321 is recessed in a shape corresponding to that of the molded end 161. Also, the seat part 321 extends lengthwise in front and rear directions of the shelf 300. Thus, in a state where the seat part 321 is seated on the molded end 161 to support the shelf 300, the shelf 300 may be slidably movable in front and rear directions.

Also, the bracket mounting part 322 may be recessed to receive a bent part 332 of the support bracket 330 that will be described below in detail. Here, the bracket mounting part 322 extends in a length direction along a side end of the shelf 300. A rib 322*a* for preventing the support bracket 330 from being separated is further disposed on the bracket mounting part 322.

The support bracket 330 is configured to support one surface of left and right surfaces of the shelf 300. The support bracket 330 may be fixed to a mounting groove 141 of a shelf mounting member 140 disposed on a cool air duct 130. For this, a fixing end 331 inserted into the mounting groove 141 is disposed on a rear end of the support bracket 330.

Also, a bent part 332 is disposed on an upper end of the support bracket 330. The bent part 332 is bent so that the bent part 332 is inserted into the bracket mounting part 322. The bent part 322 is bent again to receive the rib 322*a*. Thus, when the support bracket 330 is mounted on the bracket mounting part 322, the rib 322*a* is disposed in a space defined by the bent part 332 to prevent the support bracket 330 from being separated.

Also, the support bracket 330 supports the shelf 300 inside the bracket mounting part 322. Thus, the shelf 300 may be movable in front and rear directions along the support bracket 330.

Thus, when a user pulls the shelf 300 in the state where the shelf 300 is mounted, both sides of the shelf 300 may be movable in the front and rear directions along the molded end 161 and the support bracket 330. That is, in the state where the shelf 300 is mounted, the shelf 300 may be slidably withdrawn to receive foods and seat the received foods.

The refrigerator according to the embodiments, one side of the left and right sides of the shelf may be fixed to the molded end within the refrigerator, and the other end may be fixed to the shelf mounting member by the support bracket.

Thus, the rear end of the shelf may be stably fixed to maintain a relatively more stable fixed state. Also, even when foods are seated on a front portion of the shelf, the shelf may be maintained in a stable state.

Also, the shelf mounting member may be disposed at a central portion of the refrigerator, i.e., the cool air duct. Here, the cool air duct may be a separate injection molded part mounted on the inner case and easily mounted on the shelf mounting member. Also, since it is unnecessary to provide a separate shelf mounting member in the inner case defining the inner space of the refrigerator, the inner case may be more simplified in structure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet having a storage space therein;

a door coupled to the cabinet for opening or closing the storage space;

a vertical adjustable shelf disposed in the storage space to place foods thereon;

a cool air duct disposed in the storage space to supply cool air into the storage space;

a shelf mounting member disposed on a rear surface of the storage space, the shelf mounting member having a plurality of vertically adjustable mounting grooves; and a supporting end protruding from a side inner surface of the cabinet, which defines a side surface of the storage space, the supporting end configured to extend in a front-to-rear direction of the cabinet, wherein the shelf comprises:

a shelf plate having a surface on which foods are disposed;

a seat part disposed along a first side surface of the shelf plate and having a recess, the recess configured to be laterally recessed and extend in a front-to-rear direction of the shelf plate to receive the supporting end;

a bracket mounting part disposed along a second side surface of the shelf plate, and having a U-shaped bent portion; and a cantilever support bracket fixed to the shelf mounting member for supporting the shelf plate, the support bracket including:

fixing ends formed at a rear end thereof to be inserted in the mounting grooves; and a bent part bent twice at an upper end thereof to be received in a space formed by the U-shaped bent portion of the bracket mounting part, such that the bracket mounting part slides in the front-to-rear direction along the bent part without swaying in a left-to-right direction of the cabinet.

2. The refrigerator according to claim 1, further comprising additional shelf placed next to the shelf and fixed to the shelf mounting member.

3. The refrigerator according to claim 2, wherein the mounting grooves are arranged in two rows, and wherein the fixing ends of the shelf are inserted in a first row of the grooves and fixing ends of the additional shelf are inserted in a second row of the grooves.

4. The refrigerator according to claim 1, wherein a side part of an inner case defining the side inner surface of the cabinet protrudes to form the supporting end.

5. The refrigerator according to claim 4, wherein the recess of the seat part is recessed in a shape corresponding to a shape of the supporting end.

6. The refrigerator according to claim 1, wherein the U-shaped bent portion includes:

a first part downwardly extending from a lower end of the bracket mounting part;

a second part laterally extending from an end of the first part; and a third part upwardly extending from an end of the second part.

7. The refrigerator according to claim 6, wherein the bent part of the support bracket includes:

a first portion laterally extending from the upper end of the support bracket; and a second portion downwardly extending from an end of the first portion, wherein the third part of the U-shaped bent portion is inserted in a groove formed by the first portion and the second portion.

* * * * *